US005171142A

United States Patent [19]

Proglyada

[11] Patent Number: 5,171,142

[45] Date of Patent: Dec. 15, 1992

[54] ROTARY DISPLACEMENT MACHINE WITH CYLINDRICAL PRETENSION ON DISC-SHAPED PARTITION

[75] Inventor: Leonid P. Proglyada, Kharkov, U.S.S.R.

[73] Assignee: Tselevoi Nauchno-Tekhnichesky Kooperativ "Stimer", Kharkov, U.S.S.R.

[21] Appl. No.: 635,567

[22] PCT Filed: May 24, 1989

[86] PCT No.: PCT/SU89/00133

§ 371 Date: Jan. 14, 1991

§ 102(e) Date: Jan. 14, 1991

[87] PCT Pub. No.: WO90/14502

PCT Pub. Date: Nov. 29, 1990

[30] Foreign Application Priority Data

May 25, 1987 [SU] U.S.S.R. ..... 4247854

[51] Int. Cl.[5] ..... F04C 3/00

[52] U.S. Cl. ..... 418/68

[58] Field of Search ..... 418/68

[56] References Cited

U.S. PATENT DOCUMENTS 3,816,039 6/1974 Berry ..... 418/68
3,877,850 4/1975 Berry ..... 418/68
4,631,011 12/1986 Whitfield ..... 418/68

FOREIGN PATENT DOCUMENTS 2619474 2/1977 Fed. Rep. of Germany .
56-20704 2/1981 Japan ..... 418/68
819363 4/1981 U.S.S.R. .
877129 11/1981 U.S.S.R. .

*Primary Examiner*—Richard A. Bertsch
*Assistant Examiner*—David L. Cavanaugh
*Attorney, Agent, or Firm*—Fleit, Jacobson, Cohn, Price, Holman & Stern

[57] ABSTRACT

A rotary displacement machine has a casing (1) having a spherical interior space accommodating a rotor. The rotor is spherical and is formed by a disc-shaped partition (2) having on either side thereof pivotally vanes (3, 4). The vanes (3, 4) are connected to the partition (2) along the diameter, extend in mutally perpendicular planes and are connected to power takeoff shafts (5, 5') extending at an angle with respect to each other. The pivotal connection of the partition (2) to each vane (3, 4) is in the form of mating cylindrical projections (9, 9') of the partition of the vanes (3, 4). Axes (a, b) of the projections (9, 9') of the partition (2) extend mutually perpendicularly and in one and the same plane.

1 Claim, 2 Drawing Sheets

ROTARY DISPLACEMENT MACHINE WITH CYLINDRICAL PRETENSION ON DISC-SHAPED PARTITION

TECHNICAL FIELD

The invention relates to the mechanical engineering, and more specifically, it deals with a rotary expansion machine.

The invention may be used as a motor or pump in various power producing or power consuming plants.

BACKGROUND OF THE INVENTION

Known in the art is a hydraulic vane machine (SU, A, 819363), comprising a casing accommodating a rotor having a cam-shaped end face and a shaft. The casing has slots receiving radially extending vanes mounted for axial movement under the action of springs. During rotation of the rotor by a drive motor, the vanes which are permanently pressed against the cam end face of the rotor reciprocate to ensure regular variation of capacity of pressure and suction working chambers. The vanes divide these chambers, and the volumetric efficiency, which is the ratio of the volume of utilized fluid to the maximum volume of the working chamber, depends on quality of sealing between the end faces of the vanes and the cam end face of the rotor. It is defficult to provide an efficient sealing member on the narrow end face of the vane. Accordingly, the volumetric efficiency of the machine is rather low.

Also known in the art is a rotary displacement pump (SU, A, 877129) having a casing with an inner spherical surface mating with the outer surface of vanes having power take off shafts provided thereon to extend along their axes of summetry at an angle with respect to each other.

There is also provided a partition extending in the diametrical plane having its outer surface mating with the inner surface of the casing. Vane supports and a sealing member received in a groove are provided in the diametrical plane of the partition. This machine has an increased volumetric efficiency because of an increase in the useful volume of the working chambers with the same inside diameter of the casing. However, the provision of a sealing member that takes a part of the useful space of the working chambers lowers the possibility of increasing the volumetric efficiency. In addition, the sealing line in the diametrical plane is long and very sinuous so that is very difficult to ensure a reliable sealing.

SUMMARY OF THE INVENTION

The invention is based on the problem of providing a rotary displacement machine in which, owing to an increase in useful volume of working chambers and reduction of length of a line along which surfaces of the vanes, partitions and inner surface of a spherical casing mate with one another, an increase in the volumettic efficiency is achieved.

The invention resides in the fact that a rotary displacement machine having a casing with a spherical interior space accommodating a rotor formed by a disc-shaped partition mounted for rotation about the center of the spherical interior space and defining a pair of mutually isolated compartments, and by a pair of vanes pivotally connected to the partition to extend on either side thereof in two mutually perpendicular diametrical planes defining with the partition and with the inner surface of the casing sealed varying-capacity working chambers, each vane being rigidly secured to a respective power takeoff shaft, the axes of the shafts extending at an angle with respect to each other and intersecting each other at the center of the spherical interior space, according to the invention, the discshaped partition is continuous, and its pivotal connection to each vane comprises a diametrically extending cylindrical projection of the discshaped partition and a recess of a mating configuration provided on the end portion of the vane mating with each other, the axes of the cylindrical projections on either side of the partition extending in one and the same plane.

The provision of the cylindrical projections on the side faces of the partition having their axes extending in one and the same plane and intersecting at right angle with respect to each other at the center of the partition and the provision of mating recesses on the end faces of the vanes make it possible, owing to their conjugation with the surfaces of the cylindrical projection along a substantial area, to provide efficient sealing members between the mating surfaces in the form of glands having a soft packing (twisted, braided, laminated), mechanical sealing members, and the like which would not reduce useful volume of the working chambers. An enhanced sealing and an increase in the useful volume of the working chambers without an increase in the machine size allow the volumentric efficiency to be increased.

It is preferred that projections be provided on diametrically opposed portions of the end faces of the vanes, the length of arc of the recess in the zone of the projection being greater than the length of arc of the rest of the recess, the partition having depressions to receive the vane projections in the zone of location of these projections.

This construction of the pivotal joint between the vanes and partition makes it possible to ensure their permanent engagement and to produce a large mating surface area to achieve a reliable sealing.

BRIEF DESCRIPTION OF THE DRAWINGS

The invention will now be described with reference to its specific embodiments illustrated in the accompanying drawings, in which.

BEST MODE FOR CARRYING OUT THE INVENTION

Figure 1:
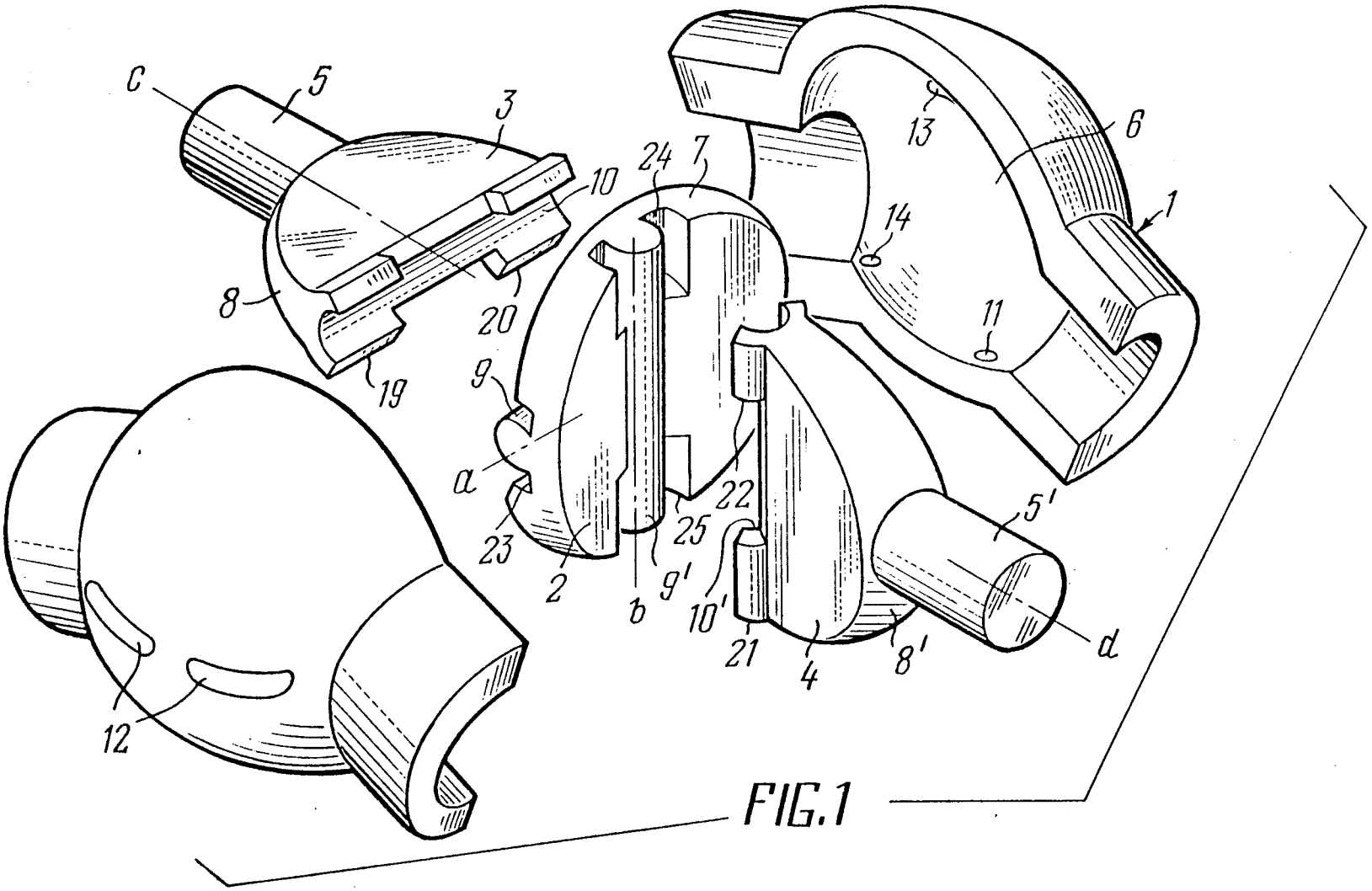
FIG. 1 shows a perspective view of a rotary displacement machine according to the invention.
Figure 2:
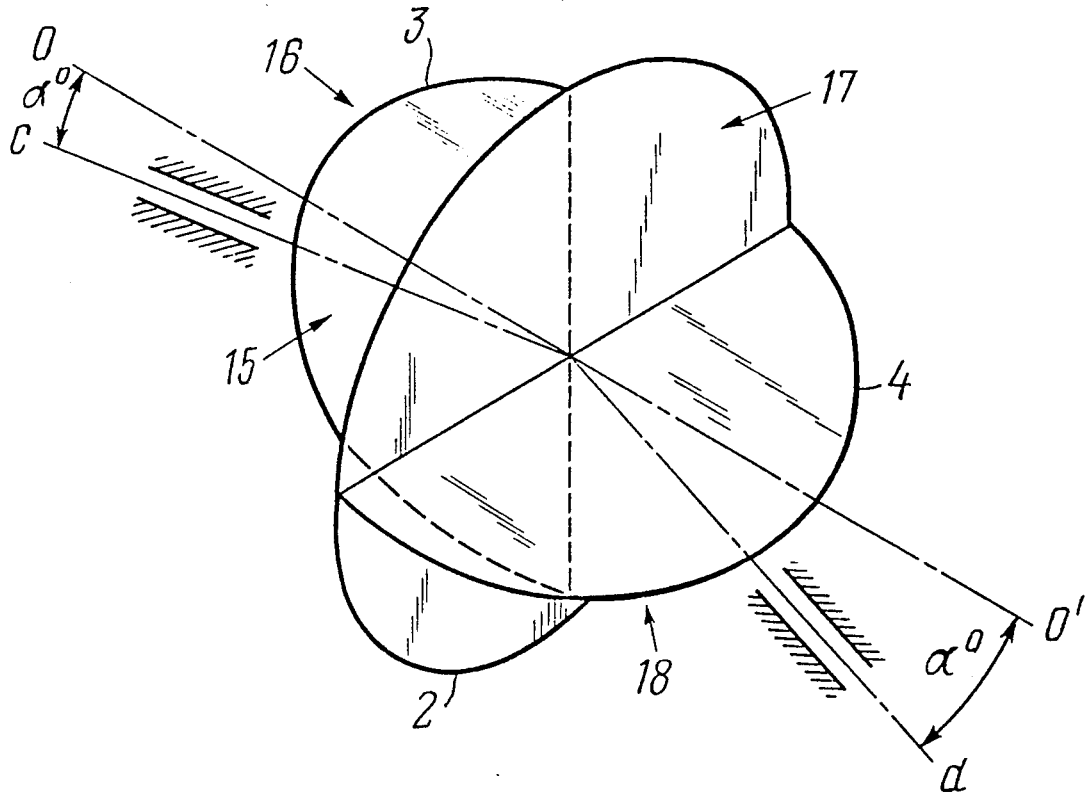
FIG. 2 is a diagrammatic view showing a rotor and a three-dimensional position of working chambers.

A rotary displacement machine according to the invention belongs to the class of rotary machines having a spherical casing and a spherical rotor, and its specific embodiment shown in FIGS. 1 and 2 may be used both as rotary displacement pump or a rotary expansion engine. The application of the machine according to the invention will be considered herein as an engine.

The rotary machine comprises a spherical casing 1 made up of the halves (FIG. 1) having an interior space accommodating a rotor which is formed by a disc-chaped partition 2 and vanes 3 and 4 connected to power takeoff shafts 5 and 5'. Each vane 3 and 4 is a part of a sphere defined by a pair of planes intersecting at an acute angle, the line of intersection of the planes extending along the diameter of the sphere. The casing 1 has an inner spherical surface 6 mating with a periphery 7 of the partition 2 and with outer surfaces 8, 8' of the vanes 3, 4.

The disc-shaped partition 2 is mounted for rotation about the center of the spherical interior space of the casing 1 and defines in the casing a pair of mutually isolated compartments.

Pivotally connected to the disc-shaped partition 2 on either side thereof there are the vanes 3 and 4 which are similar in shape to orange segments and which have the spherical outer surfaces 8,8' and end faces extending in planes diametrically defining the outer surfaces. The vanes 3, 4 are in two mutually perpendicular planes with respect to the disc-shaped partition 2.

Diametrically extending cylindrical projections 9, 9' are provided on the side surfaces of the partition 2 so that their axes a, b extend in one and the same plane drawn through the axes a and b and through the partition 2 and intersect each other at right angle at the center of this plane. Recesses 10, 10' having concave cylindrical surfaces are provided in the end faces of the vanes 3 and 4 to mate with the surfaces of the respective cylindrical projections 9, 9'. Therefore, the vanes 3 and 4 are provided to extend on either side of the partition 2 and can move with respect to the surface 2 when rotated by the power takeoff shafts.

The power takeoff shafts 5, 5' are secured to extend along axes of symmetry of the vanes 3 and 4 to their outer surfaces 8, 8' at an angle with respect to each other and extend through holes of the casing 1. The casing 1 also has an inlet port 11, exhaust ports 12 and 13 and an inlet port 14. The mating surfaces of the machine parts such as the periphery 7 of the partition 2, outer surfaces 8, 8' of the vanes 3 and 4, surfaces of the cylindrical projections 9, 9' and the concave cylindrical surfaces of the recesses 10, 10' are provided to produce conjugation along the full surface area of respective surfaces so as to allow additional sealing members to be used (not shown in the drawings) to enhance tightness of varying-capacity working chambers 15, 16, 17, 18 (FIG. 2) which are defined in the casing 1 by the vanes 3 and 4 and partition 2.

FIG. 2 schematically shows axes c and d of the power takeoff shafts 5, 5' extending at an obtuse angle with respect to each other and at acute angles to the axis $00_1$ drawn through the center of the partition 2 at right angles to its plane.

It is preferred that projections 19, 20, 21, 22 be provided at diametrically opposed portions of the end faces of the vanes 3 and 4. The length of arc of the recesses 10, 10' in these projections is greater than the length of arc in the rest of the recess. Depressions 23, 24, 25 are provided in the zone of location of these projections 19, 20, 21, 22 in the partition 2 to receive these projections. When assembled, the projections 19, 20, 21, 22 are received in the respective depressions to retain the vanes 3, 4 in the pivotal joint of the partition 2.

The rotary machine functions in the following manner. It will be apparent that the vanes 3 and 4 when assembled are pivotally connected to the partition 2 to form a rotor which is accommodated in the spherical interior space of the casing 1, and the rotor in the assembled form is schematically shoen in FIG. 2. In the description that follows, FIGS. 1 and 2 will be referred to together for a better understanding of the gist of the invention as the varying-capacity working chambers 15, 16, 17, 18 defined by the vanes 3 and 4 are best seen in FIG. 2. The casing 1 is not shown in FIG. 1 for the sake of simplicity.

Fluid (such as steam, liquid, gas and the like) is supplied in the initial position to the inlet ports 11, 14 of the casing 1 and, if the working chambers, e.g., the chambers 15, 18 communicate therewith, pressure which is built up in these chambers is greater than pressure in the working chambers 16, 17 communicating with the exhaust ports 12, 13. A pressure differential gives rise to forces acting upon the side faces of the partitiion 2 so as to develop couples of forces causing the partition 2 to move about the axis of application of couples of forces. This movement of the partition 2 is transmitted through its cylindrical projections 9, 9', projections 19, 20, 21, 22 and recesses 10 to the vanes 3, 4 which rotate the power takeoff chafts 5, 5'. As a result of rotation of the partition 2 and vanes 3 and 4, the working chambers 15, 16, 17, 18 change their position with respect to the inlet ports in such a manner that the working chamber 15 communicates with the exhaust port 12 and the working chamber 18 communicates with the exhaust port 13, the working chambers 16, 17 communicating with the inlet ports 11, 14, respectively. Therefore, pressure in the working chambers 15, 18 becomes lower than that in the working chambers 16, 17, and a couple of forces is again applied to the partition 2, vanes 3, 4 and power takeoff shafts 5, 5'. The locations of the inlet ports 11, 14 in the casing 1 are chosen to ensure the supply of fluid to minimum volumes of respective working chambers. In view of this, phases of fluid supply to the working chambers are shifted at 90°. During rotation of the partition 2 and vanes 3 and 4 their surfaces 7, 8 mating with the inner spherical surface 6 of the casing 1 as well as the mutually engageable surfaces of the projections 9, 9' and recesses 10, 10' together with eventual sealing members ensure good sealing of the working chambers 15, 16, 17, 18.

Sealing members would not take useful volume of the working chambers in the machine according to the invention, and the sealing line in the diametrical plane is comparatively short and not sinuous so as to facilitate the provision of reliable sealing. These advantages ensure an increase in the volumetric efficiency of the machine.

INDUSTRIAL APPLICABILITY

The invention may be most advantageously used in rotary steam engines as a displacement machine for transforming inner energy of a vaporous fluid into mechanical work.

The invention may be equally effectively used in compressors, pumps, hydraulic motors, for compression and pumping of fluids.

I claim:

1. A rotary displacement machine comprising a casing having a spherical interior space accommodating a rotor formed by a disc-shaped partition mounted for rotation about the center of the spherical interior space and defining a pair of mutually isolated compartments, and by a pair of vanes pivotally connected to the partition to extend on either side thereof in two mutually perpendicular planes defining with the partition and with the inner surface of the casing sealed varying-capacity working chambers, each vane being rigidly secured to a respective power takeoff shaft, the axes of the shafts extending at an angle with respect to each other and intersecting each other at the center of the spherical interior space, wherein the disc-shaped partition is continuous and its pivotal connection to each vane is in the form of a diametrically extending cylindrical projection on the disc-shaped partition and a mating recess in an end portion of each vane and axes of the cylindrical projections on either side of the partition extending in one and the same plane, and projections are provided on diametrically opposed portions of the end portions of the vanes, the length of arc of the recesses in the zone of location of these projections being greater than the length of arc in the rest of the recess, depressions being provided in the partition extending only partially through the thickness of the partition in the zone of location of the projections to receive these projections.

* * * * *

UNITED STATES PATENT AND TRADEMARK OFFICE

CERTIFICATE OF CORRECTION

PATENT NO. : 5,171,142

DATED : December 15, 1992

INVENTOR(S) : PROGLYADA

It is certified that error appears in the above-identified patent and that said Letters Patent is hereby corrected as shown below:

On the title page, item (86) should read--

§ 371 Date: Jan. 24, 1991

§ 102(e) Date: Jan. 24, 1991

--.

Signed and Sealed this

Twenty-sixth Day of April, 1994

*Attest:*

Bruce Lehman

BRUCE LEHMAN

*Attesting Officer*

*Commissioner of Patents and Trademarks*